US010311697B2

(12) United States Patent
Weissman

(10) Patent No.: US 10,311,697 B2
(45) **Date of Patent: *Jun. 4, 2019**

(54) ALLERGY WARNING AND PROTECTION SYSTEM WITH BEACON ENHANCED WEARABLE FOR PROACTIVE TRANSMISSION AND COMMUNICATION OF ALLERGY INFORMATION

(71) Applicant: Avram Weissman, Lawrence, NY (US)

(72) Inventor: Avram Weissman, Lawrence, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/914,862

(22) Filed: Mar. 7, 2018

(65) Prior Publication Data

US 2018/0197392 A1 Jul. 12, 2018

Related U.S. Application Data

(63) Continuation of application No. 15/336,874, filed on Oct. 28, 2016, now Pat. No. 9,916,747.

(60) Provisional application No. 62/247,994, filed on Oct. 29, 2015.

(51) Int. Cl.

| | |
|---|---|
| ***G08B 21/00*** | (2006.01) |
| ***G08B 21/04*** | (2006.01) |
| ***G08B 25/08*** | (2006.01) |

(52) U.S. Cl.

CPC ..... *G08B 21/0453* (2013.01); *G08B 25/08* (2013.01)

(58) Field of Classification Search

CPC ..... G08B 21/0453; G08B 21/02
USPC ..... 340/539.12
See application file for complete search history.

(56) References Cited

U.S. PATENT DOCUMENTS

2004/0199056 A1* 10/2004 Husemann ..... A61B 5/0002 600/300
2009/0085743 A1* 4/2009 Ravi ..... G06K 7/0008 340/572.1
2012/0223834 A1* 9/2012 Hyatt ..... G08B 21/0247 340/539.13
2012/0286959 A1* 11/2012 Ray ..... G08B 21/043 340/627
2015/0091703 A1* 4/2015 Buono, III ..... G16H 10/60 340/10.4
2015/0109101 A1* 4/2015 Gomez ..... G07C 9/00111 340/5.54

* cited by examiner

*Primary Examiner* — Mark S Rushing
(74) *Attorney, Agent, or Firm* — Stern & Schurin LLP

(57) ABSTRACT

An allergy warning and protection system and method to proactively warn a user and protect a dependent individual, such as a child, suffering from allergies. The system comprises a beacon housed within a wearable, such as a bracelet, that is worn by the dependent. The beacon has an associated identifier that is linked to data stored on a server that corresponds to the allergy and sensitivity levels of the dependent individual with an allergy, indicating that the child is allergic to peanuts, eggs, gluten and/or other allergens. When in use, the beacon transmits identification data to a handheld device operated by a user which is utilized to retrieve the allergy and other confidential information, such as emergency contact information, from the server and to issue an alert notification to the user. In a preferred embodiment, a layer of privacy is provided so that a user must first be "trusted" before receiving confidential information about a person with allergies.

13 Claims, 21 Drawing Sheets

ALLERGY WARNING AND PROTECTION SYSTEM WITH BEACON ENHANCED WEARABLE FOR PROACTIVE TRANSMISSION AND COMMUNICATION OF ALLERGY INFORMATION

RELATED APPLICATIONS

This application claims priority to U.S. application Ser. No. 15/336,874, filed on Oct. 28, 2016, now allowed, which claims priority to U.S. provisional application 62/247,994, filed on Oct. 29, 2015, both of which are incorporated herein by reference.

FIELD OF THE INVENTION

This invention relates to an allergy warning and protection system and method. More particularly this invention involves a system and method for protecting dependent individuals, such as children, from being unintentionally exposed to food-based and other allergens. When in use, the invention enables the efficient and precise proactive transmission and communication of complete allergy information of a dependent individual to a caregiver through the utilization of a token that is in wireless communication with a handheld device of the caregiver without the need for any further input by or communication from the dependent individual.

BACKGROUND OF THE INVENTION

Food allergies in children appear to be on the rise. Although close family members are typically aware of a child's food allergies and associated limitations, there are instances when food allergy information of a particular child is not properly communicated to others who may be responsible for the care of a child over a temporary period of time (e.g., teachers of a child with an allergy; parents of a child's friend; relatives of a child with a food allergy who do not live with the child). Compounding the problem is that children and other dependent individuals with allergies often may forget to advise a caregiver of an allergy, potentially leading to calls for an ambulance, hospital visits and/or use of an Epi-Pen.

Existing means to avert unintentional exposure to allergens are deficient in many respects. Although many are designed to warn of allergens, they are not entirely effective. Table 1 below demonstrates the effectiveness of various prior art measures for issuing allergy warnings to third parties:

TABLE 1

Prior Art Warning and Protection Measures and Features

| Feature | Verbal Warning | T-Shirt | Temporary Tattoo/Sticker | No-Tech Bracelet |
|---|---|---|---|---|
| Visual Alert | N | Y | Y | Y |
| "Cool" for Kids/Teens | N | N | N | Y |
| Always Appropriate | N | N | N | Y |
| Customize to Any Allergy | Y | N | N | N |
| Child Specific Information | Y | Y | Y | N |
| Protects Privacy | Y | N | N | Y |
| Gives Emergency Information | N | N | Y | N |

TABLE 1-continued

Prior Art Warning and Protection Measures and Features

| Feature | Verbal Warning | T-Shirt | Temporary Tattoo/Sticker | No-Tech Bracelet |
|---|---|---|---|---|
| Constant Protection | N | N | N | N |
| Proactive Alert | N | N | N | N |

Existing wearables or trinkets which visually communicate allergy information are often inadequate to serve the needs of dependent individuals with allergies and the caregivers or other individuals that need to be aware of them. For example, t-shirts, bracelets and temporary tattoos that incorporate a prominent visual representation of a peanut and/or the word "PEANUT" are often not entirely effective in communicating information necessary to avert an unwanted reaction to an allergy. In particular, these warning measures do not communicate whether the individual is extremely sensitive to peanuts and can be affected by airborne allergen exposure, or whether that same individual is only sensitive to peanuts when they are ingested.

Moreover, prior art measures of warning and protecting against allergen exposure are generally passive. All rely on constant verbal reminders and/or ineffective visual reminders. None provide a proactive alert system for keeping caregivers and other individual advised of an allergy.

Based on these drawbacks and deficiencies, there is an urgent need for an allergy protection and warning system that automatically and wirelessly communicates complete food allergy information and does not rely on the verbal communication of allergy information by a dependent individual to a caregiver. There is also a need to implement preventative measures in schools, amusement parks, airports and other establishments with children so that exposure to allergens can be limited. Thus, there is a need to limit exposure by utilizing wireless communications so that allergy information can be communicated amongst individuals (i.e., between individuals with allergies and others) even when they do not know one another and/or are not otherwise aware of the other's presence.

SUMMARY OF THE INVENTION

In view of the drawbacks and deficiencies present in the prior art, it is a primary object of the present invention to provide a proactive allergy warning and protection system that automatically and wirelessly communicates complete food allergy information;

It is another object of the present invention to provide an allergy warning and protection system that eliminates the need for verbal input of allergy information of a dependent individual to a caregiver or other individual;

It is a further object of the present invention to provide an allergy warning and protection system that eliminates the need for wearables (e.g., t-shirts, bracelets, tattoos) that overtly communicate allergy information in a manner that may result in isolation, awkwardness, bullying and/or social stigma to an individual suffering from an allergy;

Another object of the present invention is to provide an allergy warning and protection system that is appropriate for all settings and dress codes and is water resistant;

Yet another object of the present invention is to provide an allergy warning and protection system that is highly customizable for a wide variety of different allergies and shares other medical conditions and information (e.g., asthma);

A further object of the present invention is to provide an allergy warning and protection system that protects the privacy of individuals with allergies by limiting the sharing of information to trusted friends and family;

Another object of the present invention is to provide an allergy warning and protection system that provides emergency information in the event of allergen exposure;

An additional object of the present invention is to provide an allergy warning and protection system that is always recognized even when traditional forms of allergy prevention are covered or hidden.

In view of the drawbacks and deficiencies of the prior art, there is provided an allergy warning and protection system and method. In a preferred embodiment and implementation of the system and method, a bracelet is provided that wirelessly communicates with an application on a typical handheld device, such as a smartphone. Preferably, the bracelet is initially associated with information or data corresponding to the allergy information for a dependent individual, such as a child or other individual who will be wearing the bracelet, indicating that the child is allergic to peanuts, eggs, gluten and/or other allergens. The bracelet transmits identification data to the handheld device which is utilized to report the beacon identification data to a server (e.g. a cloud-based server). In response to reporting the beacon identification data to a server, the handheld device receives a proactive notification containing allergy information associated with the beacon that is embedded in the bracelet. Allergy information and optionally other confidential information, such as emergency contact information, is transmitted to one or more other users that possess the application on their handheld device to advise those users of the allergies of the dependent for which they are assuming temporary care or who may otherwise be in their proximity.

In a most preferred embodiment, the allergy warning and protection system and method protects a dependent child with an allergy and is configured to be operated by a user utilizing a smartphone device having an interface display screen, Internet connectivity and location identifying technology. The dependent child wears a token, preferably a water-resistant (including waterproof) bracelet, that encapsulates a communication beacon which generates and emits a signal encoded with a unique identifier code. After receiving the signal with the unique identifier code, the smartphone, which follows program instructions stored on a non-transitory computer readable medium, queries a database that has a plurality of data entries or values that are linked to the bracelet beacon and, specifically, its unique identifier code. The values stored on the database corresponding to each bracelet include or are defined by the unique identifier code, one or more an allergy IDs which each correspond to an allergen, and one or more allergy sensitivity level IDs, which correspond to the level of sensitivity to an allergen. The system further includes a processor controlled server that is operatively connected to the smartphone device to access the database in response to the query from the smartphone device, utilizing the unique identifier code in order to retrieve the allergy ID and allergy sensitivity ID of a particular PA. After retrieving the information, the processor controlled server returns the allergy ID and allergy sensitivity ID to the interface display screen of the smartphone to visually and/or audibly notify the user and to provide a visual representation of the allergy ID and the allergy sensitivity level ID.

In a preferred embodiment of the allergy warning and protection system and method, a layer of security and privacy is provided so that a user with the application can only receive confidential information associated with a bracelet after the user is first approved by the bracelet holder (i.e., typically a parent of the child who is the person with an allergy, or dependent person with an allergy who is wearing the bracelet). By using this authentication system, a user with the application will not automatically have access to all individuals (and/or their corresponding confidential information) wearing an allergy bracelet, but only to those that have approved the user. Authentication can take place at any time prior to use of the system and transmission of the allergy information. All users, however, receive an alert or notification that a person or dependent with an allergy (i.e., "PA") is in the users' proximity—along with the specific allergens that must be avoided—thereby enabling the users to take appropriate actions.

In a most preferred embodiment, in order to avoid unwanted communications of allergy information, allergy information is transmitted to a user's handheld device exclusively when that user's handheld device is within a relatively short, and pre-determined range from a bracelet. In that regard, it would be most advantageous to implement the foregoing system utilizing Near Field Communications ("NFC") technology or Bluetooth technology, and in particular, BLE or Bluetooth low energy, to complete the necessary communications between bracelet beacon and handheld device. Other forms of communication and proximity location that incorporate GPS and/or RFID may also potentially be utilized as suitable alternatives.

It should be understood and appreciated that a "user" refers to a user of the application of the present invention that resides on a handheld device. "PA" refers to a single person with one or more allergies. In most instances a PA is a dependent individual with an allergy, such as a young child or teenager. However, it should be appreciated that in many different contexts, a PA also may refer to an adult. It should further be understood and appreciated that a "user" and "PA" may, in a number of instances, be the same individual. Accordingly, these terms are not necessarily mutually exclusive.

It should also be appreciated and understood that references in this specification to one or more of the following terms: "bracelet," "wristband," "pendant," "trinket," "token" and "wearable" are interchangeable with one another, unless specifically stated otherwise, or as evident from the context of the specification. In addition, it should be appreciated and understood that references in this specification to a "smartphone" or "handheld device" generally refers to a smartphone, and are interchangeable with one another, unless specifically stated otherwise, or as evident from the context of the specification. By the same token, it should be appreciated and understood that these terms may include other connected devices such as a smart watch, smart TV, PC, tablet, laptop or other device that may be incorporated into an embodiment of the system and method described herein.

Although often discussed in the context of food-based allergens, it should be appreciated and understood that the utility and benefits of the system and method described herein are also applicable to non-food based allergens, such as pollen, as well as certain diseases, such as Celiac Disease, which is an autoimmune disorder defined by damage to the small intestine resulting from the ingestion of gluten.

BRIEF DESCRIPTION OF THE DRAWINGS

The above-described and other advantages and features of the present disclosure will be appreciated and understood by those skilled in the art from the following detailed description and drawings of which.

DETAILED DESCRIPTION OF THE INVENTION

Figure 1:
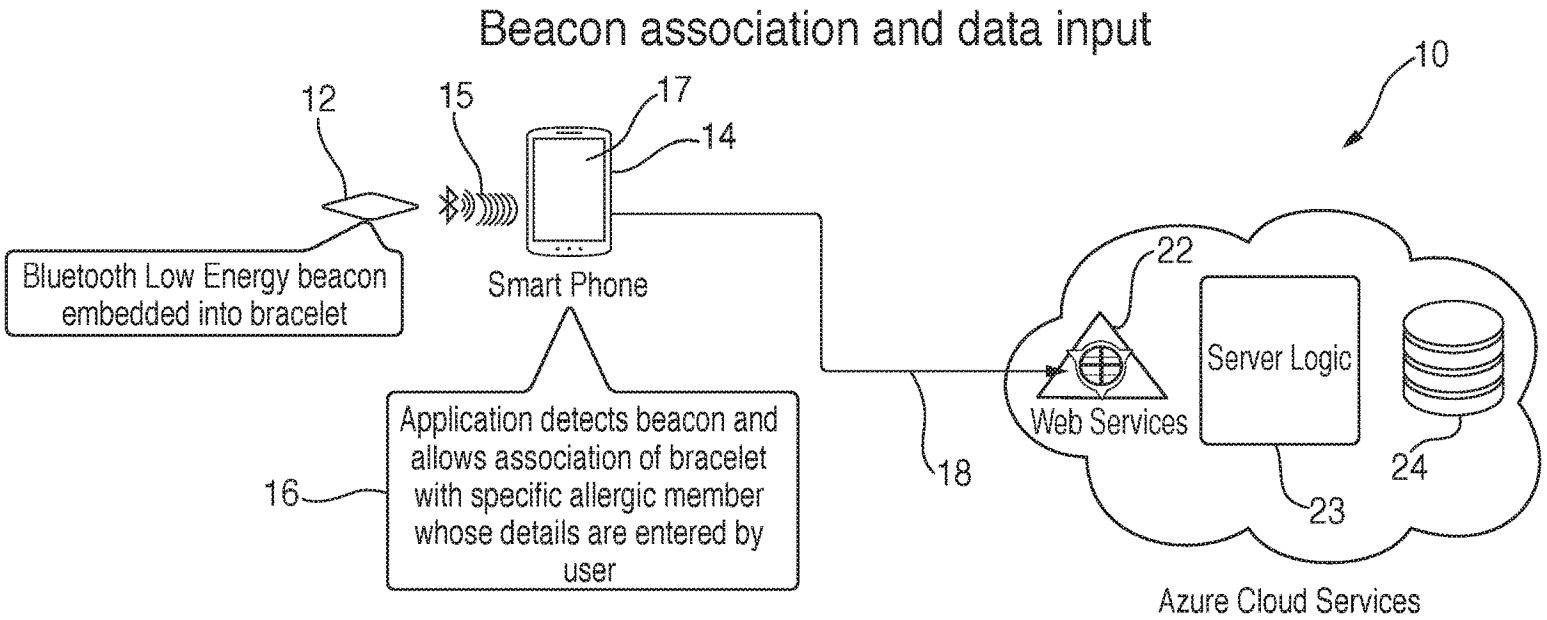
FIG. 1 is a system diagram illustrating beacon association with a handheld device and transmission of data via a network to the backend of the system where data is stored.

With reference to FIGS. 1 through 36, there is shown a preferred embodiment of an allergy warning and protection system 10 and corresponding method. The system and method enables a user to pair or associate one or more bracelet beacons 12 with a single person who possesses one or more allergies (i.e., "PA"). Linking a bracelet beacon 12 to a PA enables the proactive communication and display of the complete and correct allergic member information on a smartphone 14 or other handheld device when a beacon is detected, as illustrated in FIG. 1.

Figure 35:
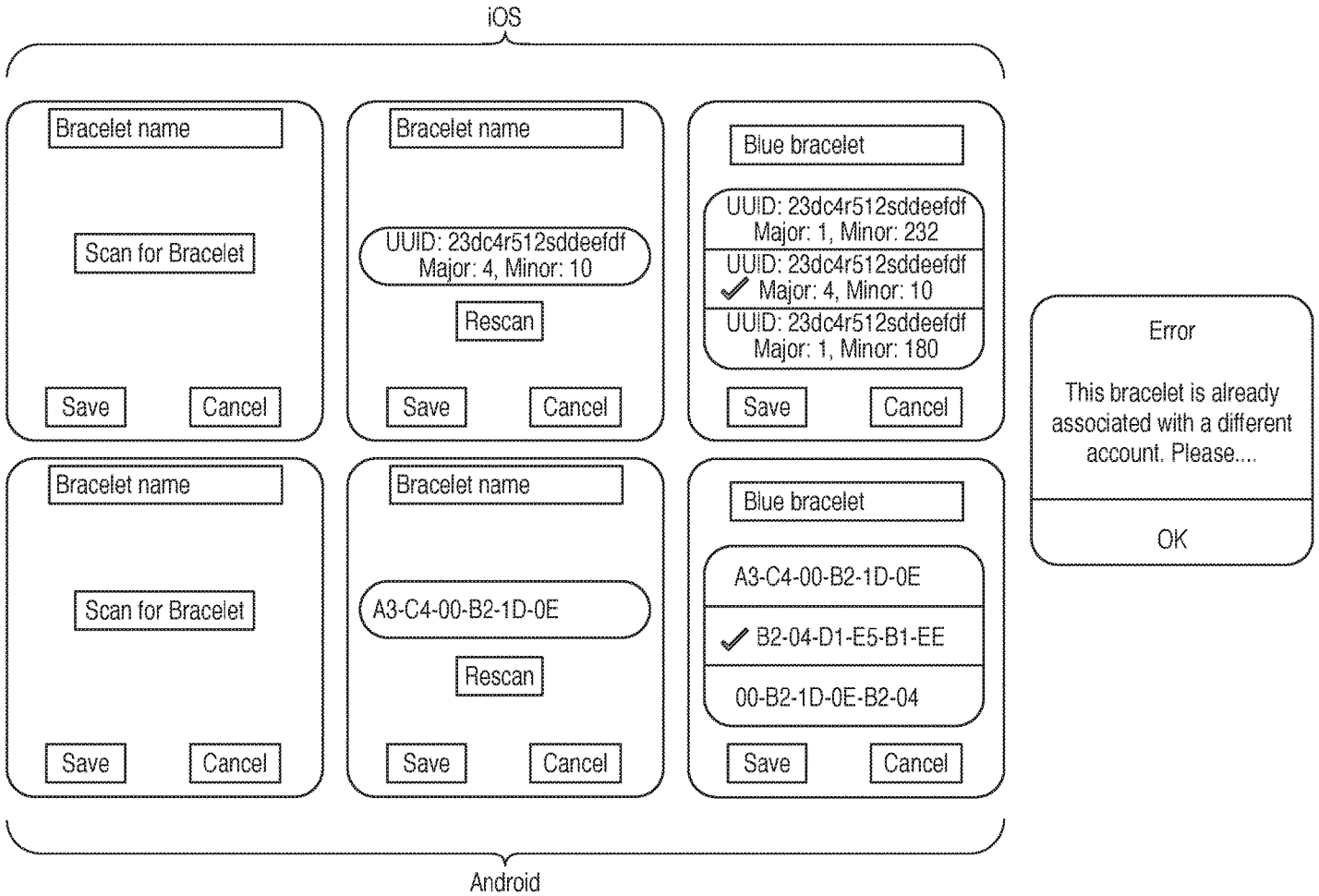
FIG. 35 illustrates an alternate exemplary graphical user interface or display adding a bracelet to an account.

With reference to FIG. 1, a process for beacon association and data input pertaining to a PA is illustrated in the context of the allergy warning and protection system 10. The association process between a PA and beacon 12 is performed by entering the "beacon/member pairing" mode of the application, which may commonly be referred to the "Add a Wristband" feature, shown in FIG. 13. This function pairs a beacon 12 embedded in a bracelet with a PA. In this mode, the application scans for Bluetooth low energy beacons 15 with a predefined UUID and, upon detection 16, displays the beacon information on the smartphone interface 17. When multiple beacons are detected, a user with a handheld device selects a beacon from a list of beacons and continues on to enter the PA's allergy details and other information. The PA's data and beacon information, such as the UUID, major, minor and mac address values, examples of which are shown in FIG. 35, are transmitted 18 to a cloud server 20 via the cloud API 22 and saved to a database 24.

Figure 2:
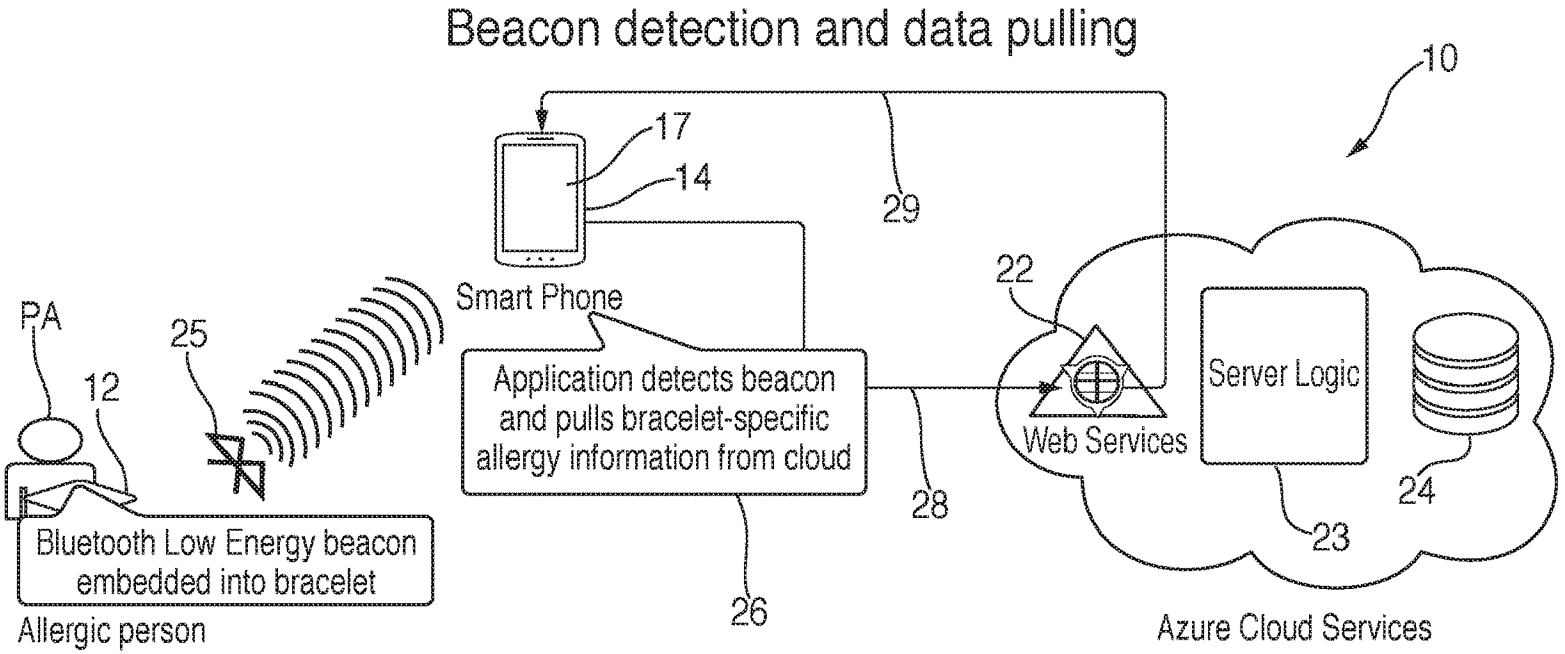
FIG. 2 is a system diagram illustrating beacon detection by a handheld device and extraction of bracelet-specific allergy information from the cloud.

With reference to FIG. 2, a process for beacon detection and data pulling in the context of the allergy warning and protection system 10 is illustrated. A handheld device 14 with the application constantly or continuously scans for Bluetooth low energy beacons 25. Upon detecting 26 a beacon 12 embedded into a bracelet worn by a PA, the application interface 17 displays a notification regarding the detected beacon. When the application is active, the application on the smartphone 14 sends a query 28 to the cloud server 20 regarding the detected beacon 12 and server 20, in turn, returns the data 29 of the PA (e.g., allergy information, emergency contacts, other information) that is associated with the detected beacon 12 notifying the user of the smartphone 14 that a beacon corresponding to a PA has been detected. This proactively alerts the user to the presence of a PA and to take appropriate action, without the user, for example, having to notice the bracelet on the PA or receiving a verbal queue from the PA about the PA's allergies and sensitivity level thereto.

System 10 may be implemented in part by utilizing one or more servers operated by machine-readable software instructions present on non-transitory computer readable storage media to perform a variety of functions. With respect to the hardware of the system, CPU-based hardware, computers, and/or servers are arranged to communicate with one another and with one or more databases and/or data stores, preferably residing therein, which are used to store data of the types described herein. When and after data is stored, the servers and software parse and filter the data pursuant to encoded instructions to allow a user to search for specific data. In addition to using on-site hardware and software, it should be appreciated that data may be stored on non-transitory hardware storage media provided by a third party service. Likewise, the application software with program instructions may be implemented, virtually or otherwise, utilizing secure services provided by a third party service.

The system is implemented utilizing a relational database for storing information regarding beacon bracelets, PAs and the relationship between the two, as well as additional metadata regarding the PAs, emergency contact numbers and allergy information. The database also stores the mobile application user credentials and analytics data.

An application programming interface ("API") is also provided as an interface between the server-side code and database and the mobile applications and website. In a preferred embodiment a RESTful API is utilized which allows ender users to connect to an interact with cloud services 20 that are utilized in accordance with the allergy warning and protection system 10.

Server logic 23 includes the algorithms and rule sets for dealing with the various functionality and use-case scenarios of the mobile application and administration website. Preferably, most of the system logic is implemented on the server-side, as opposed to being implemented on the website and mobile applications. The administration website enables CRAD functions (i.e., Create, Replace, Add, Delete) on user data and PA data. It is used to display analytical data and usage reports as well as administration of the mobile applications' users.

Figure 3:
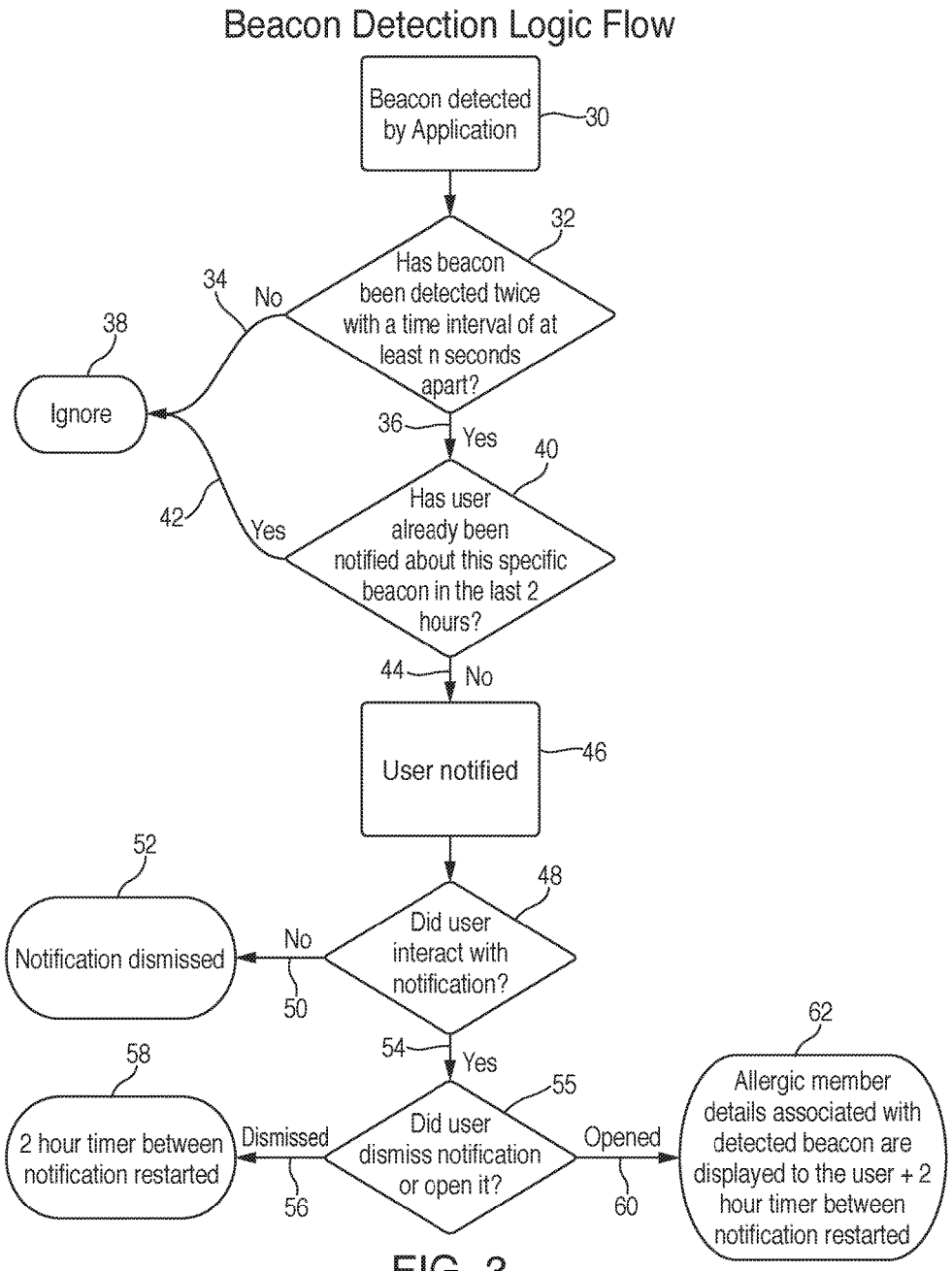
FIG. 3 is a flow chart depicting an exemplary process for beacon detection.

With reference to FIG. 3, a series of steps are preferably followed after a beacon is detected to ensure proactive notifications are provided or "pushed" to users on a sufficiently frequent basis about a PA whose beacon has been detected. The steps presented in FIG. 3 operate most effectively in the context of the Android platform when the application is open and/or running in the background, with suitable modifications available, which are known to those of ordinary skill in the art, in the context of the iOS platform.

It should also be appreciated that the content of notifications sent in response to beacon scanning and detection may vary depending on the operating platform. For example, proactive notifications on a device operating on an Android platform incorporate additional details about a PA, including the allergen or allergy ID and allergy sensitivity level ID and name of the PA. By contrast, proactive notifications on a device operating on an iOS platform may simply notify a user that a PA has entered the vicinity without providing details about the PA, such as allergy ID, allergy sensitivity level ID and name of the PA.

Initially, when a beacon is detected 30, a query 32 and corresponding determinations 34, 36 are made as to whether the beacon has been detected twice within an n-second interval. Generally, the interval should be sufficiently short, such as 20-120 seconds, and most preferably 60 seconds, such that there is confidence that the detected beacon is within range of the Bluetooth communications. If the beacon is not detected twice within the n-second interval 34, then the detection of the beacon is ignored 38. If the beacon is detected twice within the n-second interval 36, another query 40 and corresponding determinations 42, 44 are made as to whether the user has been notified about the beacon within the past two hours. If so 42, the detection is ignored 38. If not 44, the user is notified 46, preferably through a proactive push notification. Thereafter, determinations are made as to whether the user acknowledged or interacted with the notification 48. If a user does not interact 50 with the notification, that notification is dismissed 52. Conversely, if the user does interact 54 with and dismisses the notification 56, the 2-hour timer is restarted 58. And, if the user opens the notification 60, PA details associated with the detected beacon are displayed to the user 62, and the 2-hour timer is restarted.

It should be appreciated and understood that the timing of program step or query 40 may be modified such that the notification time may be reduced or increased, as desired, from 2 hours. In that regard notifications may be sent even more frequently, as desired, to ensure sufficient proactive push notifications to a user of a PA whose beacon has been detected. In a preferred embodiment, notification intervals are further reduced below 2 hours to about 15-30 minutes in order to increase the frequency of notifications. By the same token, it should be appreciated that push notifications may be sent less frequently (e.g., 2 to 6 hours) to ensure that a user is not receiving too many or redundant notifications. Optionally, users may be provided with a control to set the frequency of notifications.

Figure 4:
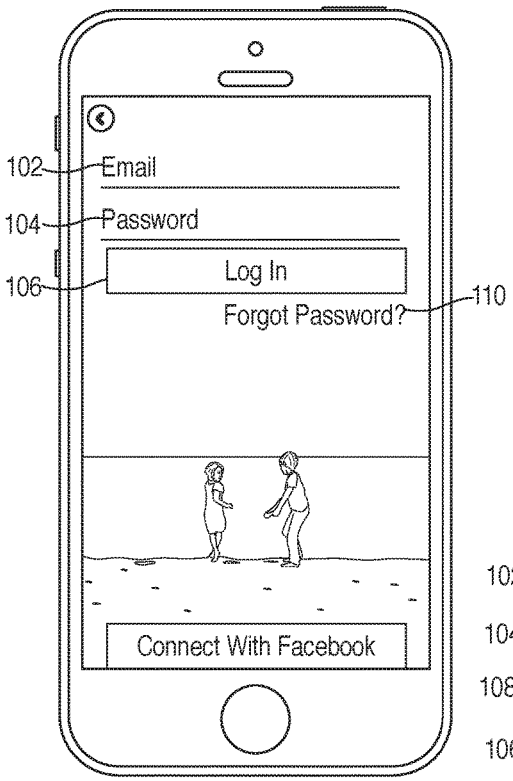
FIG. 4 illustrates an exemplary graphical user interface or display of a user login in accordance with an exemplary embodiment of the claimed invention.
Figure 5:
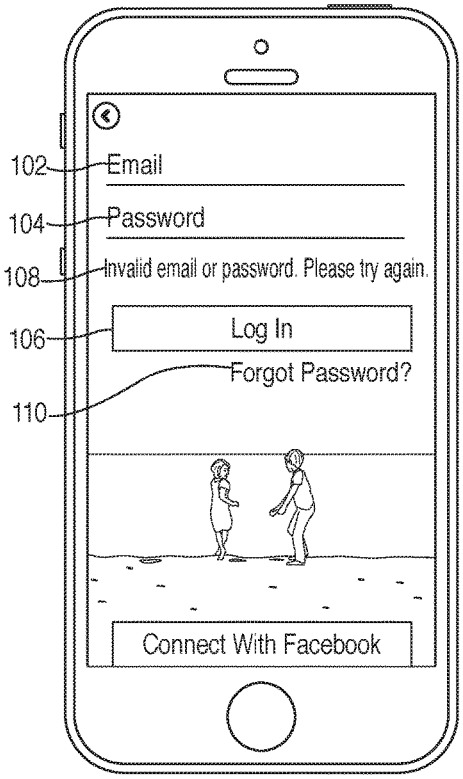
FIG. 5 illustrates an exemplary graphical user interface or display of a user login error, after an incorrect email or password is entered, in accordance with an exemplary embodiment of the claimed invention.

The system and methods of the present invention are implemented in part via a series of graphical user interfaces which are illustrated in FIGS. 4 through 34 and which are described herein. With reference to FIG. 4 and FIG. 5, there is shown an exemplary graphical user interface or display of a user or administrative login. In a preferred embodiment, the login interface is the first interface displayed to a user after installation and/or opening of the application from a closed mode. The login interface comprises a field to input an email address 102 and field to input a password 104. Upon entering both an email address and password a user actuates login button 106. After pressing the login button 106, the inputted email address and password undergo data validation based on predefined criteria. These criteria cover the number of characters and allowed characters (e.g., 8 characters long, and !, &, %, $, # are not allowed). It should also be appreciated that a username which is not in the form of a valid email address may be used in place of an email address at the login interface, if desired, while still keeping within the spirit and scope of the invention.

Generally, login button 106 is only enabled for actuation (e.g., highlighted or clickable) when an email and password combination is entered. Upon entry of an email and password combination, actuating login button 106 performs a query to a server. If a correct email and password combination is entered, the interface proceeds to and displays a home screen, as presented in FIGS. 10 through 12, and explained below in further detail. Alternatively, if an incorrect email and password combination is entered, the interface displays an error message 108, as shown in FIG. 5, advising a user that an invalid email and/or invalid password has been entered. An error message may also be displayed if a user has not yet confirmed an email address using the appropriate validation link sent via an email.

Figure 6:
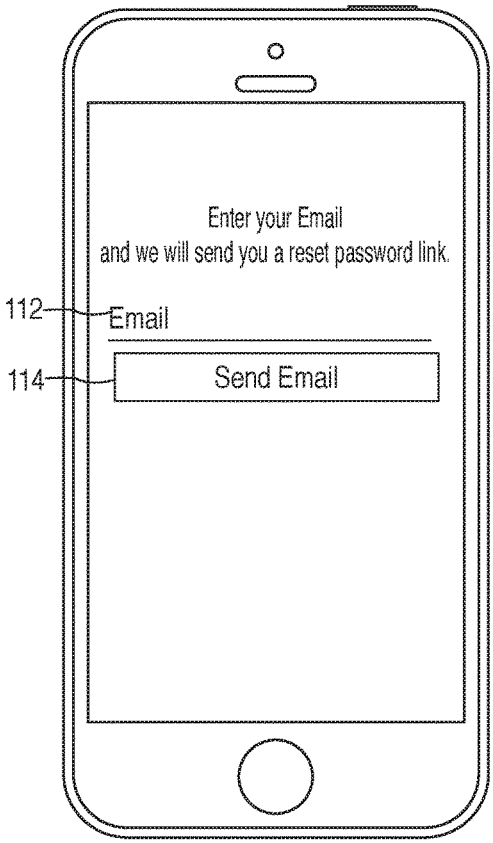
FIG. 6 illustrates an exemplary graphical user interface or display to reset a password in accordance with an exemplary embodiment of the claimed invention.

As shown in FIG. 6, a password recovery link interface is provided. The interface is provided with an email field 112 and send email button or link 114. After inputting the email address and pressing the send email button or link 14 a user is provided with a password link that is sent to the email address input into field 112. In an alternate embodiment, a forgot password link or button 110 on FIG. 4 and FIG. 5 is enabled only if a properly formatted email address is already entered into the email field 102. Once the forgot password link or button 110 is actuated, a server is instructed to send the user password (or a reset password link) to the email address that is input into the email field 102, without requiring a separate user interface for password recovery that is illustrated in FIG. 6.

Figure 7:
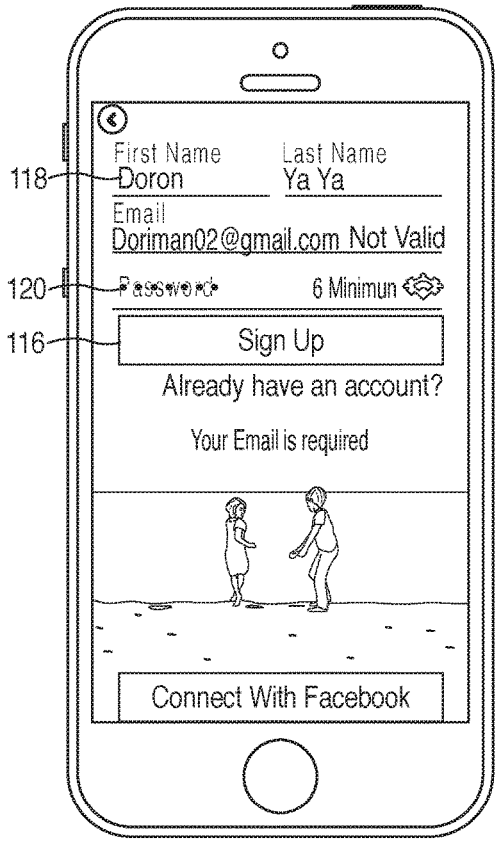
FIG. 7 illustrates an exemplary graphical user interface or display for signing up for an account in accordance with an exemplary embodiment of the claimed invention.
Figure 8:
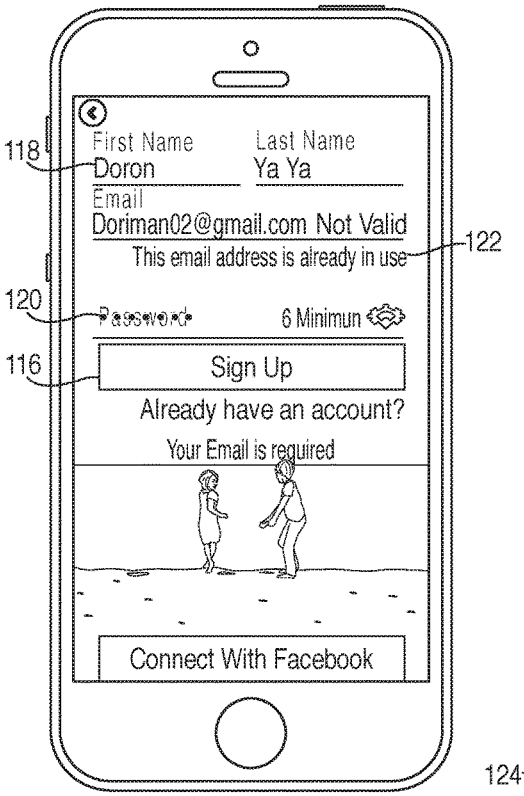
FIG. 8 illustrates an exemplary graphical user interface or display of a sign up error, after a previously used email address is entered upon sign up, in accordance with an exemplary embodiment of the claimed invention.
Figure 9:
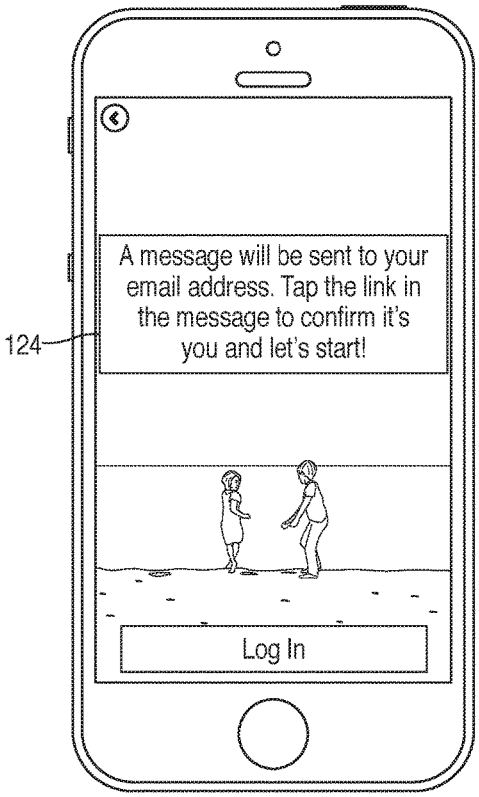
FIG. 9 illustrates an exemplary graphical user interface or display notifying a user of a sign up email confirmation link in accordance with an exemplary embodiment of the claimed invention.

With reference to FIG. 7, for a first time user or a user that desires to open a new account, a sign up link or button 116 is provided at an exemplary graphical user sign up interface or display. In a preferred embodiment, the sign up or registration interface is displayed to a user after a user actuates the sign up button 116. At the sign up or registration interface, an email and password input fields 118, 120 undergo data validation based on predefined criteria. Actuating sign up button 116 performs a query to server. Entry of inappropriate or deficient data into each of the email field 118 and password field 120 results in an error message 122, such as one shown in FIG. 8, which results from the input of an email address that is already in use. Conversely, the entry of appropriate data into each of the email field 118 and password field 120 results in the display of a message 124 instructing a user that an email validation link has been sent to the user's email address, as shown in FIG. 9. Once the email validation link is actuated, the user is registered.

Prior to being directed to the home interface (which can occur prior to or after registration), an end user license agreement ("EULA") interface is provided whereby a user must accept the terms of a license before being permitted to utilize the application. Typically, although not by necessity, the EULA is displayed only once and once it accepted, a user does not revisit EULA interface in subsequent logins. Exceptions may include instances where the EULA is amended and a user is asked to accept the amended EULA terms.

Figure 10:
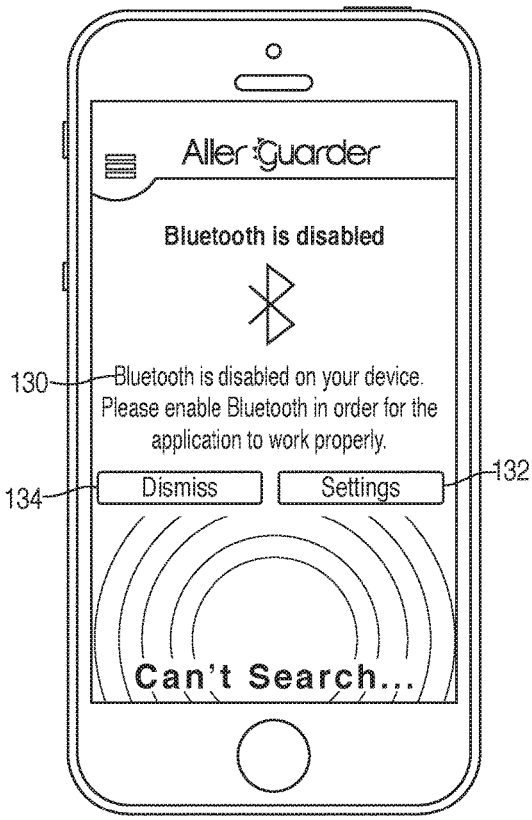
FIG. 10 illustrates an exemplary graphical user interface or display notifying a user that Bluetooth communication ability is disabled on a handheld device and instructing user to enable Bluetooth communication capability, in accordance with an exemplary embodiment of the claimed invention.
Figure 11:
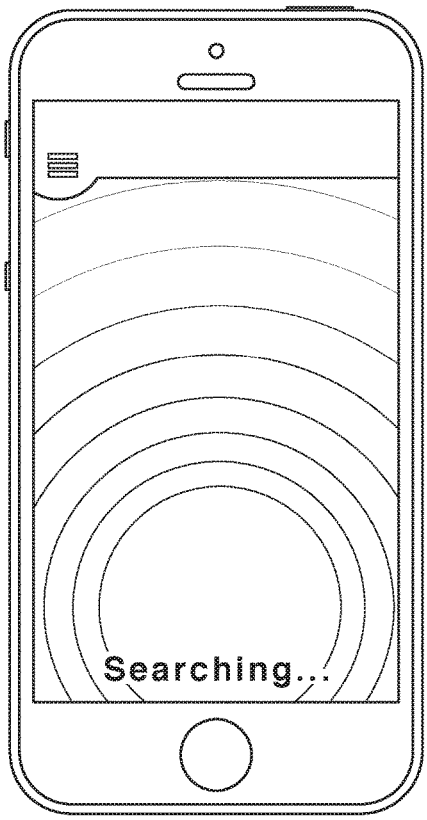
FIG. 11 illustrates an exemplary graphical user interface or display demonstrating a search function.
Figure 12:
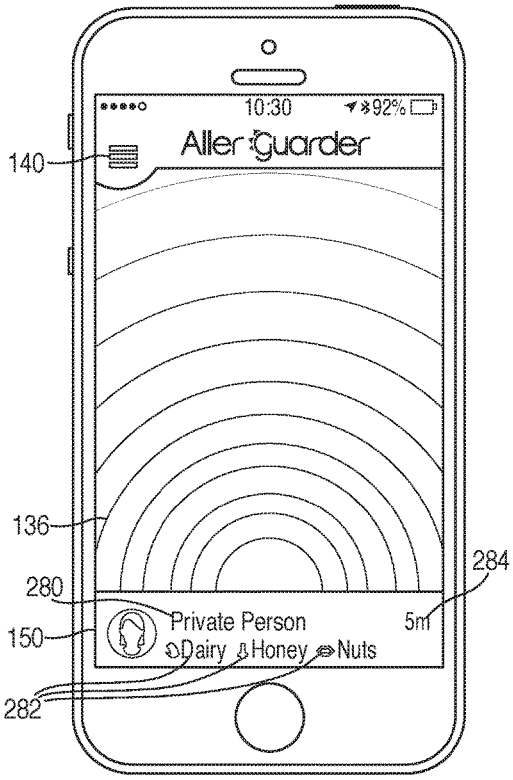
FIG. 12 illustrates an exemplary graphical user interface or display with a private PA listing on the application home page.

With reference to FIGS. 10 through 12, there is shown an exemplary graphical user interface or display of a home page in accordance with an exemplary embodiment of the claimed invention. The home page interface is displayed to a user after a successful login. Prior to display of the home page interface, a query is performed to determine whether Bluetooth communications are enabled. As illustrated in FIG. 10, upon reaching the home interface, if Bluetooth communication is set to OFF, an appropriate alert 130 is displayed, advising a user to switch Bluetooth communication to an ON setting on the handheld device. At the bottom of the interface, there is also a visual indication that searching for a beacon cannot be performed. A settings button 132 is provided to navigate the user to a device settings interface to allow the user to switch Bluetooth communication to an ON setting on the handheld device. A dismiss button 134 is also provided to dismiss or cancel the alert.

With reference to FIG. 11, upon reaching the home interface, if Bluetooth communication is set to ON, an animated display is shown which animates continuously to demonstrate that the application and handheld device is scanning for beacons. When scanning, an indicator or other visual indicia 136 is provided on the interface that indicates that the application and handheld device is scanning for beacons. When one or more beacons 12 are detected 26, the beacon identifiers are transmitted 28 via the appropriate communications module (e.g., Wi-Fi, mobile data, Bluetooth, etc.) of the handheld device 14 to server 20, ultimately resulting in the receipt notifications and visual representations of one or more allergy IDs and allergy sensitivity level IDs that correspond to each of the detected beacons.

Figure 28:
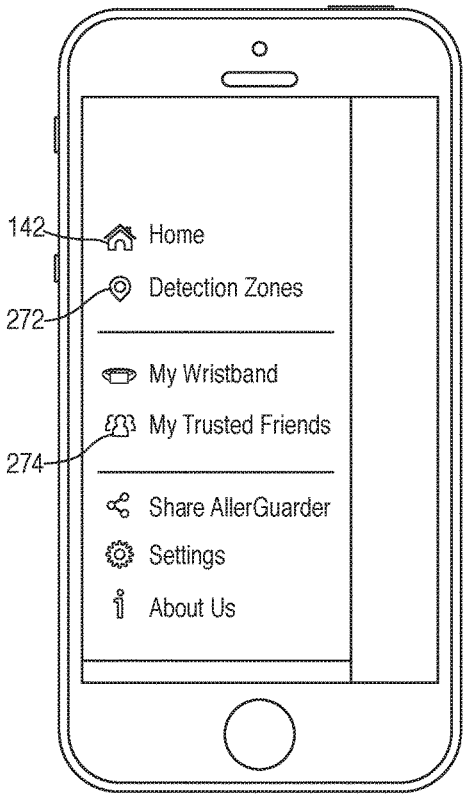
FIG. 28 illustrates an exemplary graphical user interface or display of a main or account menu, in accordance with an exemplary embodiment of the claimed invention.
Figure 29:
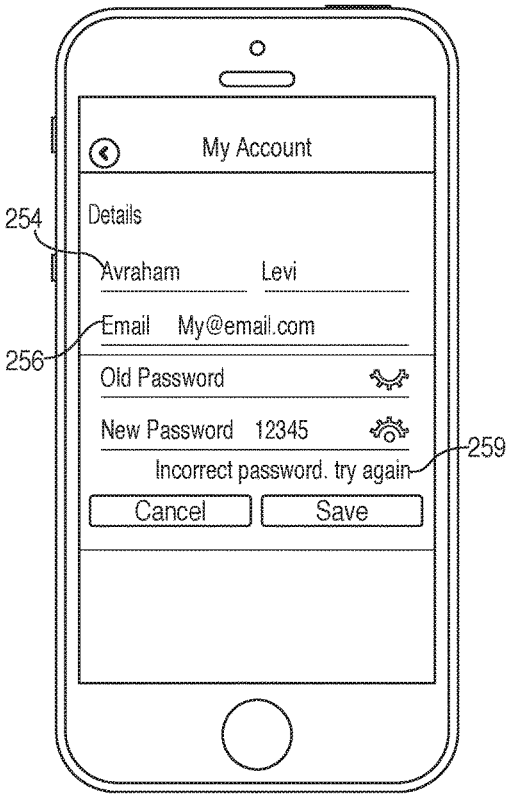
FIG. 29 illustrates an exemplary graphical user interface or display of a My Account edit menu selected from a settings menu, in accordance with an exemplary embodiment of the claimed invention.
Figure 30:
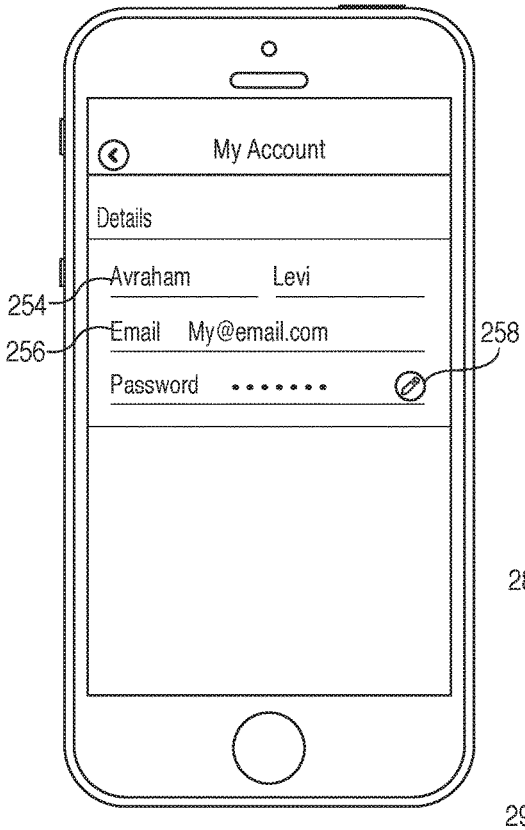
FIG. 30 illustrates an exemplary graphical user interface or display of a My Account menu selected from a settings menu, in accordance with an exemplary embodiment of the claimed invention.

With further reference to FIGS. 10 through 12, a menu button 140 is provided in the top left corner of the interface which displays the side-sliding main menu 142 illustrated in FIG. 28. Included on the main menu 142 are links to other interfaces (e.g., Home, Detection Zones, Add Wristband (or Add Bracelet) or My Wristband, My Trusted Friends, Share, Settings, About Us).

Figure 31:
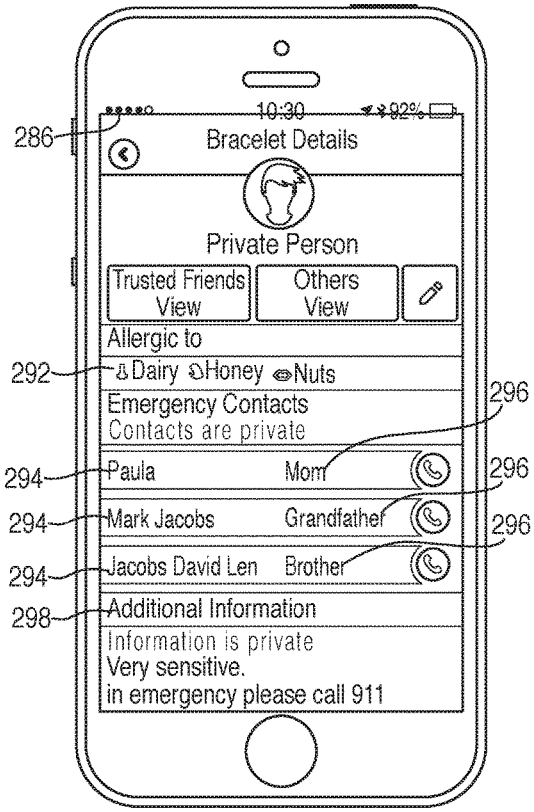
FIG. 31 illustrates an exemplary graphical user interface or display of PA profile details, including allergy information and emergency contact information.

With reference to FIG. 12, as data with details are received from the server about one or more PAs, the names of each PA (if the application user is designated as a 'trusted user' for that PA) and allergens and sensitivity levels are displayed on the interface in summary fields or cells 150. If the application user is not designated as 'trusted,' the PA will be listed as 'private' or some other similar designation. If several PAs corresponding to detected beacons are retrieved, a scrollable list of cells is displayed with the animated scanning indicator. When scrolled upwards, the list of PAs may cover the animated radar indicator and can be pulled to the top of the interface. Each cell listed on the interface shown in FIG. 12 stands for a PA, whether designated 'private' or by other name or identifier. Each cell may also be selected to access and display additional profile details or information, as shown in FIG. 31. Aside from the information provided with the basic PA listing in FIG. 12, which includes a "private" PA designation 280, allergen and sensitivity level designations 282 and a proximity measurement 284, profile details (or bracelet details) 286 are provided after the listing is selected and accessed. In the profile details, allergen and sensitivity level designations 292 are also provided, as well as emergency contacts 294 and their relation to the PA 296, and additional information 298, if made public by the user setting and controlling that PA's bracelet beacon information and profile setup. If the user is designated as trusted, that user may access all available information, including the PA's name, for example. In other words, the details and information that are displayed depends in part on whether or not the user is defined as a "trusted friend" of the PA member/bracelet. If a user is trusted, full details are disclosed. In other instances, information and personal details (e.g., birthdate, telephone numbers) of a PA may be designated as public or private. When designated as public, such details are displayed to users who are defined as a "trusted friends" as well as to other users. Generally, details are displayed in a scrollable list of cells similar to that used in the Add Wristbands data input. Thus, if a PA passes by a user who as the application installed and operating on a smartphone, and the PA is wearing a bracelet then if the user is a trusted friend of that PA, the user will see all of the PA's data, even if some of it is marked as private. However, if the user is not a trusted friend of the PA, the user will only see the PA's publicly designated information.

To help ensure that the interface with PAs displays predominantly current information, PAs that correspond to detected beacons will only be displayed if the last time of detection is within a predetermined time period. That range may be anywhere from, for example, five minutes to 60 minutes, with the most preferable range being between five and ten minutes. Once time expires and a beacon from a PA is not detected, the PA corresponding to the beacon that was not detected is removed from the list of PAs and interface and no (further) notifications are sent regarding that PA. In a preferred embodiment, the list of PAs that correspond to detected beacons is sorted by most recent time of detection, with the PA corresponding to the most recently detected beacon at the top. Optionally, when a beacon is initially detected and first notification is sent, the PA corresponding to that beacon may be listed with an animation (e.g., flashing) and/or custom sound. The interface may also provide the current distance between the beacon or bracelet and the handheld device.

Figure 13:
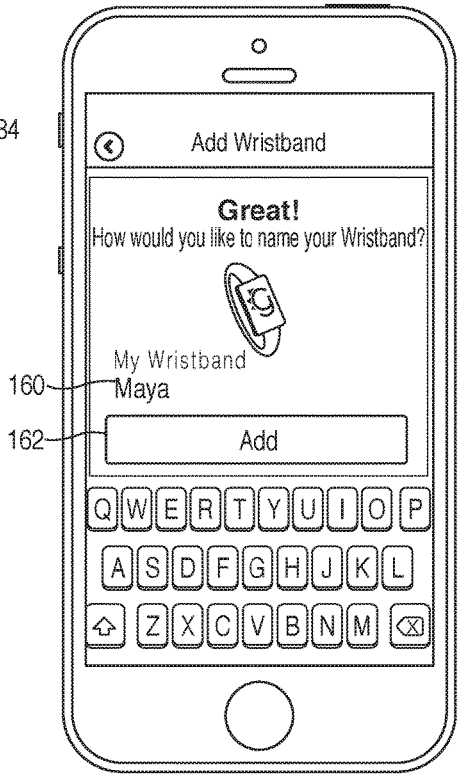
FIG. 13 illustrates an exemplary graphical user interface or display for adding a wristband of a PA linked to a user account.
Figure 14:
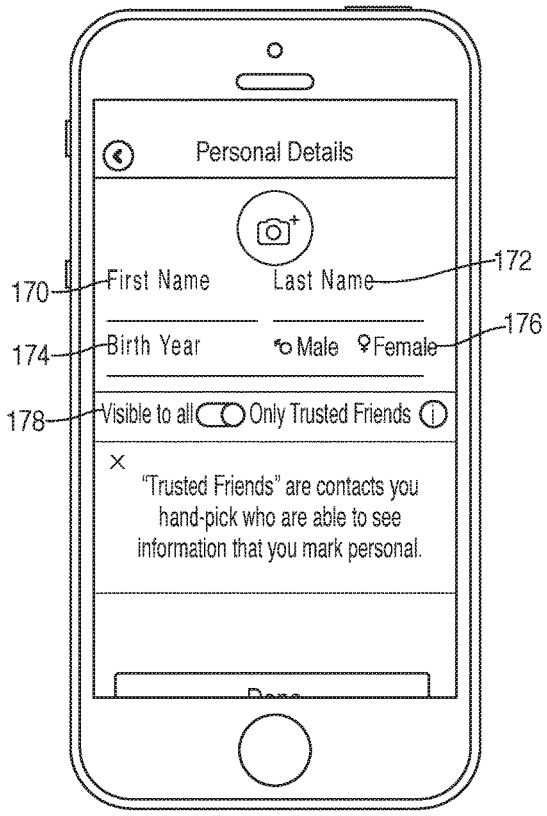
FIG. 14 illustrates an exemplary graphical user interface or display for inputting personal details and visibility toggle between "all" and "trusted friends" associated with a PA linked to a user account.
Figure 32:
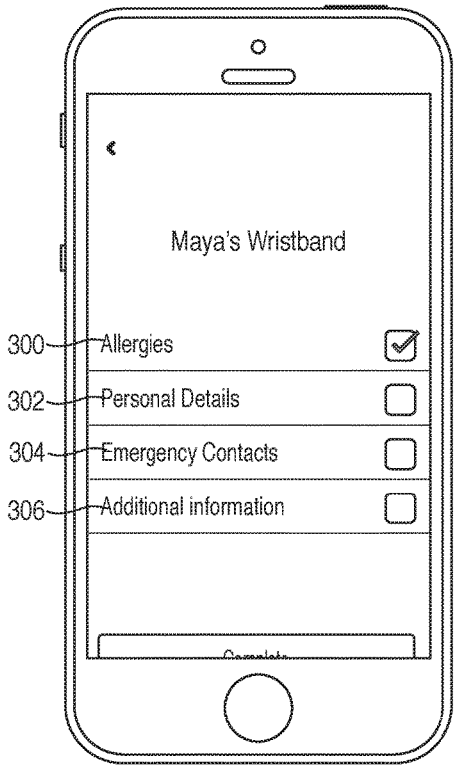
FIG. 32 illustrates an exemplary graphical user interface or display for adding a PA wristband named "Maya" including allergy data, personal details data, emergency contact data and additional information data.

From the main menu 142, an exemplary graphical user interface or display is provided through which a user may add a bracelet or wristband that is linked to the account, as shown in FIG. 13 and FIG. 14. In a preferred embodiment, the interface is displayed to a user after a user actuates an add bracelet button from the main menu 142. Upon the initial pairing, a user is prompted to name the bracelet or wristband in the My Wristband field 160. After naming the wristband, a user presses the add button 162. Thereafter, an interface, as shown in FIG. 32 is displayed to a user, through which a user enters information corresponding to a PA's allergies 300, personal details 302, emergency contacts 304 and additional information 306. Once created the PA's information is linked to the beacon and bracelet to which a name or identifier is assigned. In a preferred embodiment, a user must input data corresponding to the allergies 300 data set. After at least one allergen item is added, a user may save that information and the beacon or bracelet information to the account.

Figure 27:
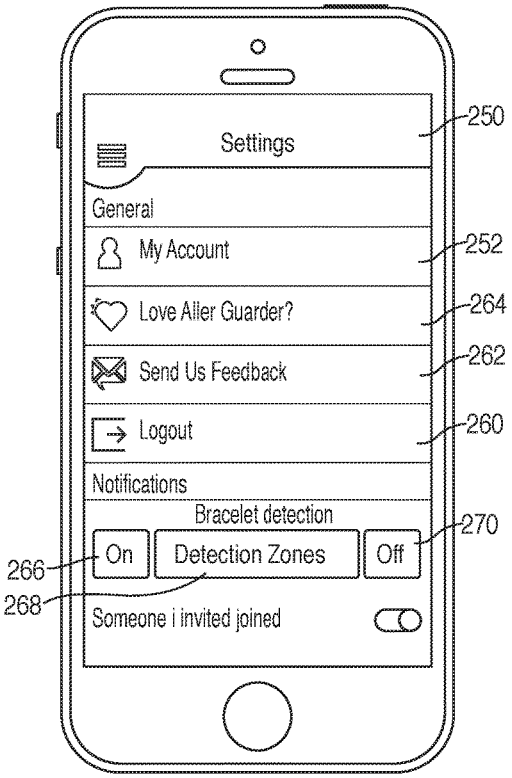
FIG. 27 illustrates an exemplary graphical user interface or display of a settings menu, in accordance with an exemplary embodiment of the claimed invention.
Figure 33:
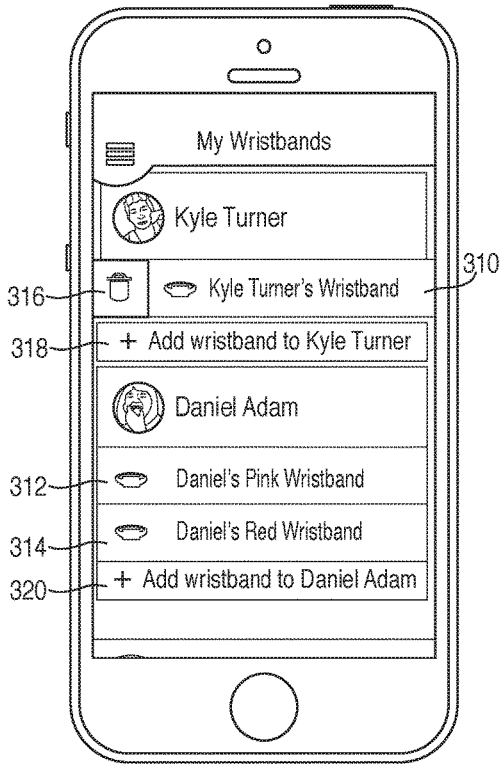
FIG. 33 illustrates an exemplary graphical user interface or display for associating one or more wristbands to PAs linked to a user's account.

Through the main menu shown in FIG. 27, a user may access, review, add, delete and edit the wristbands or bracelets associated with an account by clicking the My Wristband button on the main menu. As shown in FIG. 33, a list of associated bracelets is displayed in an interface in a vertically scrollable list. Each cell 310, 312, 314 includes a bracelet name assigned by a user who configured and chose the name. Optionally, additional information may also be listed and provided, including the MAC address of the bracelet. Right-swiping a cell optional displays a delete confirmation button 316 to enable the deletion or disassociation of a bracelet that is linked or associated with a particular user's account. A user may also add wristbands or bracelets associated with different PAs. Thus, in FIG. 33, there is a single wristband assigned to the PA, Kyle Turner, called "Kyle Turner's Wristband" but there are two wristbands, "Daniel's Pink Wristband" and "Daniel's Red Wristband," assigned to the PA designated Daniel Adam. For each PA, a user may add more wristbands by selecting the "Add wristband" controls 318, 320. It should be appreciated that when adding more than one wristband to be associated with a given PA, each wristband is set up individually. Thus different information may be provided and linked to a given wristband. Likewise, such data may be designated public or private in accordance with the disclosure set forth above.

Figure 34:
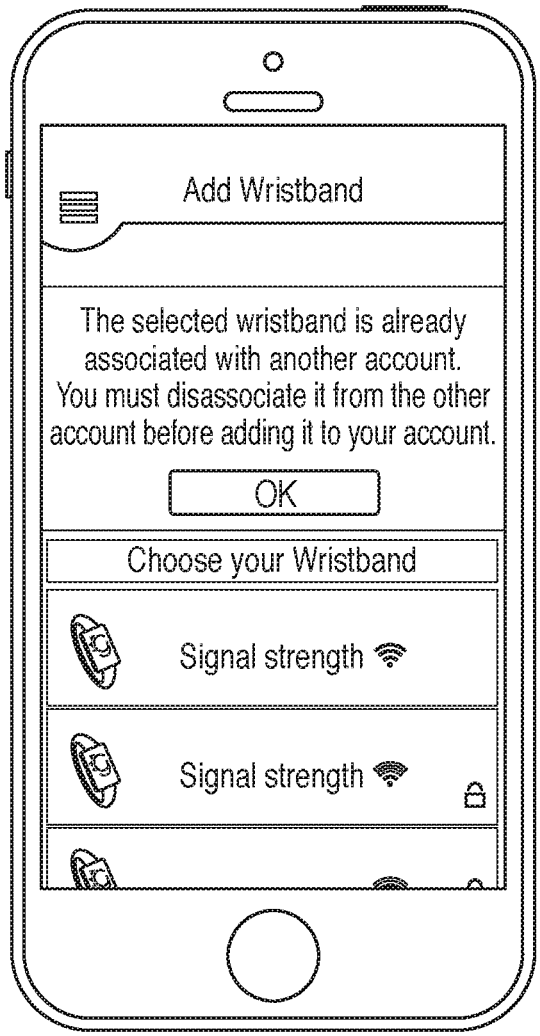
FIG. 34 illustrates an exemplary graphical user interface or display providing a wristband association error message.

As shown in FIG. 34, in the event a user attempts to associate a selected wristband or bracelet with the user's account but the selected wristband or bracelet is already assigned to another account, an error message is provided. The error message indicated that the selected wristband or bracelet is associated with another account. Before being added to the user's account the wristband or bracelet must first be disassociated with the other account.

With reference to FIG. 14, an exemplary graphical user interface or display for inputting personal details is provided in the form of text input fields. These fields are provided for the input data corresponding to the First Name 170, Last Name 172 and Birth Year 174 of the member or PA wearing the account-associated bracelet. A Male/Female selection or segmented control option 176 is also provided. Furthermore, a "trusted friends" toggle switch 178 is provided which allows the user to decide whether all persons can view the information of the PA, or whether that information is limited to "trusted friends." When information is entered and completed, a user can press the done button 179 to save the information.

Figure 15:
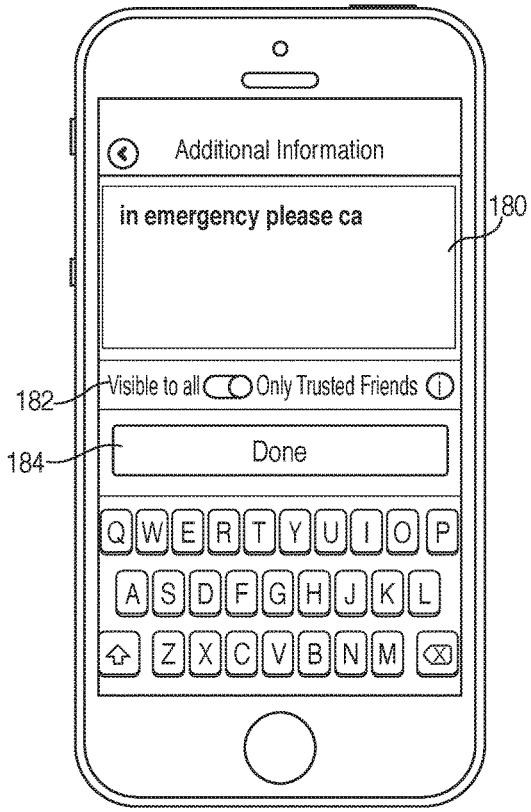
FIG. 15 illustrates an exemplary graphical user interface or display for inputting additional information associated with a PA linked to a user's account.

With reference to FIG. 15, an exemplary graphical user interface or display for inputting additional information about a PA is provided. This interface provides a large text input field 180 for the user to write free text describing special conditions, instructions or information regarding allergies of a PA and other situational information. The additional information can be marked public and visible to all or available only to "trusted friends" using a toggle switch 182. When information is entered and completed, a user presses the done button 184 to save the information. When marked public, the information text is available to other users whose smartphone can detect the bracelet linked to that information text, even if the PA's identity is kept confidential.

Figure 16:
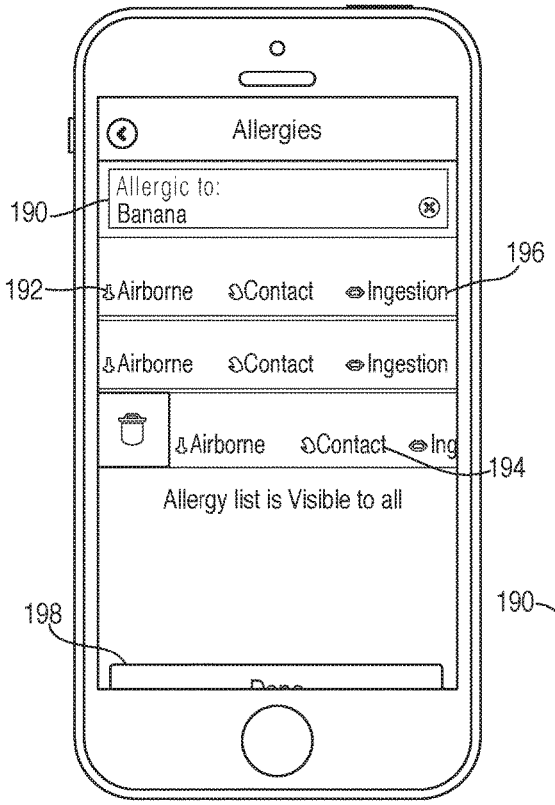
FIG. 16 illustrates an exemplary graphical user interface or display for inputting allergy categories, including allergen and sensitivity level (i.e., airborne/contact/ingestion)
Figure 17:
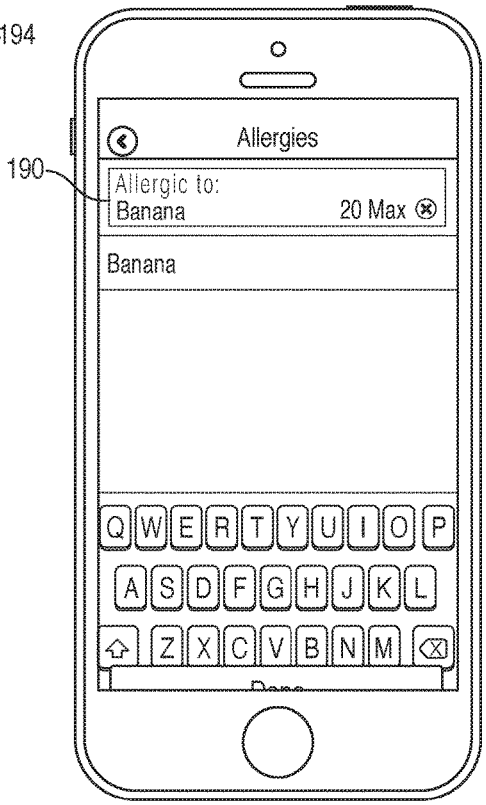
FIG. 17 illustrates an exemplary graphical user interface or display for inputting an allergen.

With reference to FIG. 16 and FIG. 17, exemplary graphical user interfaces or displays for inputting allergy categories, including the name or ID of an allergen and the allergy sensitivity level (i.e., airborne/contact/ingestion) are provided. A list of common allergens is maintained in a database and is accessible by entering an allergen in search field 190, as shown in FIG. 17. Upon selecting an allergen item that satisfies the search input, a multi-select button enables the user to also designate the type of allergy a PA suffers from with regard to the selected allergen item. The available choices comprise airborne 192 (i.e., allergens that cause an allergic reaction to a PA located with the vicinity of the allergen), contact 194 (i.e., allergens that cause an allergic reaction to a PA when the allergen comes into direct contact with the PA) and/or ingestion 196 (i.e., allergens that cause an allergic reaction to a PA only when the allergen is ingested by the PA). Preferably, the least severe designation, ingestion 196, will be selected upon default if none of the others are actively selected. Notably, regardless of privacy settings that limit the disclosure of personal and other details, an allergen and sensitivities to a PA are disclosed publicly, but without disclosing the identity of the PA, the PA's other personal information or other information that may be designated as 'trusted' or 'private.' In an alternate embodiment, a pre-populated list of allergens may be provided from which a user may select and add one or more allergens, as well as designating sensitivity level or allergy type for each. When information is entered and completed, a user presses the done button 198 to save the information.

When allergy information is provided about a PA, it is preferable for that information to also be color-coded to specify the allergy level of the allergen that affects the PA. In that regard, allergens that are divided into the three groups noted above—airborne, contact and ingestion—are also color-coded. For example, if a particular PA (or user) is affected and displays an allergic reaction to peanuts when peanuts are in the vicinity of a PA (i.e., without direct physical contact or ingestion), then the interface will display PEANUTS in, for example, red print to demonstrate that peanuts are a severe or airborne allergen to the PA. By the same token, if a particular user is affected and displays an allergic reaction to pollen when pollen comes into direct contact of a PA, then the interface will display POLLEN in, for example, orange print to demonstrate that pollen is a moderate or contact allergen to the PA. It should be appreciated that different allergens affect different PAs differently. Thus, while peanuts may be an airborne allergen to some PAs, it may only cause an allergic reaction through contact or ingestion in other PAs. By the same token, some allergens may affect a PA via ingestion, yet result in no allergic reaction in others. To help a user differentiation how the same or different allergens affect designated PAs, a color-coded legend is provided at the bottom of the interface to explain what the colors mean (e.g., RED=airborne level allergen sensitivity; ORANGE=contact level allergen sensitivity; BLACK=ingestion level allergen sensitivity).

Figure 18:
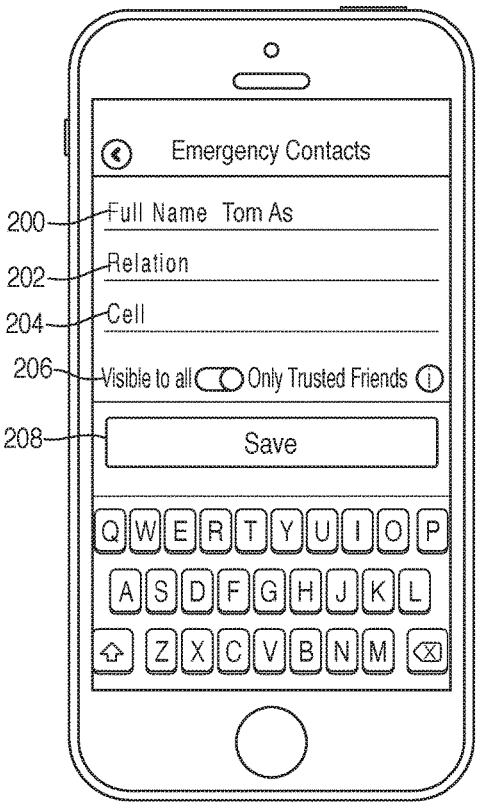
FIG. 18 illustrates an exemplary graphical user interface or display for emergency contact detail information input.
Figure 19:
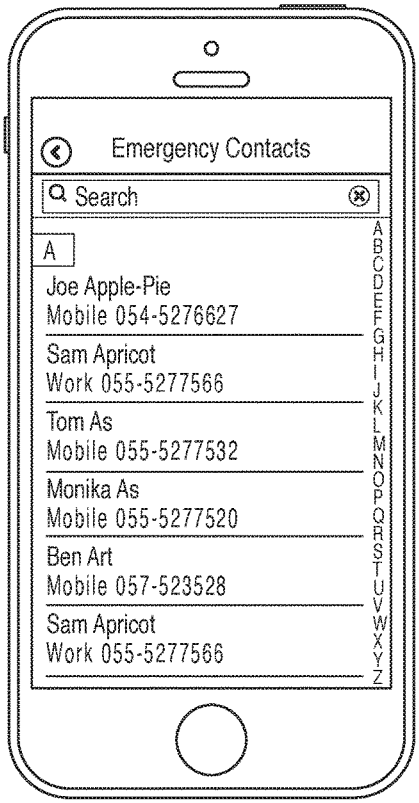
FIG. 19 illustrates an exemplary graphical user interface or display of an emergency contact list.
Figure 20:
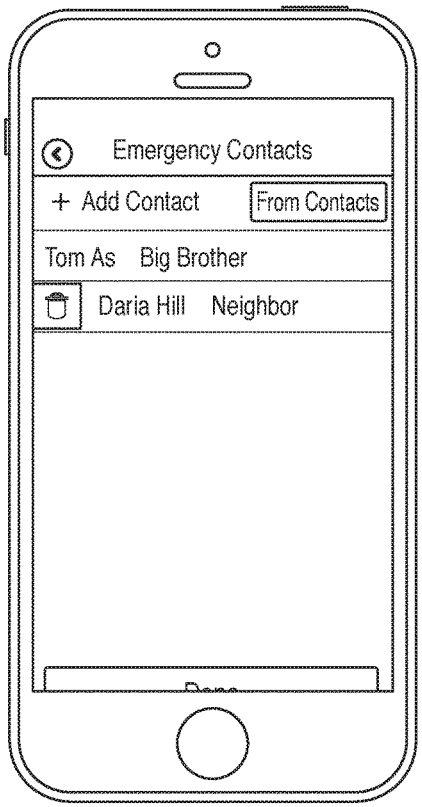
FIG. 20 illustrates an exemplary graphical user interface or display of listed emergency contacts and control option for adding more contacts.

With reference to FIGS. 18 through 20, exemplary graphical user interfaces or displays for retrieving, inputting and linking emergency contacts to a PA are provided. Emergency contact input fields, such as full name 200, relation to the PA 202, phone number of the emergency contact 204 are provided within which to enter emergency contact information. The emergency contact's information can be marked public and visible to all or available only to "trusted friends" using a toggle switch 206. When information for a particular contact is entered and completed, a user presses the save button 208 to save the information. In situations where a user's smartphone is pre-populated with contacts, a user may optionally designate one of those contacts as an emergency contact by first searching a selecting one of those contacts as shown in FIG. 19 and FIG. 20. After being selected, additional information about that contact, such as the relation to the PA may be input as well. Likewise, the emergency contact's information can be marked public and visible to all or available only to "trusted friends" using toggle switch 206.

Figure 21:
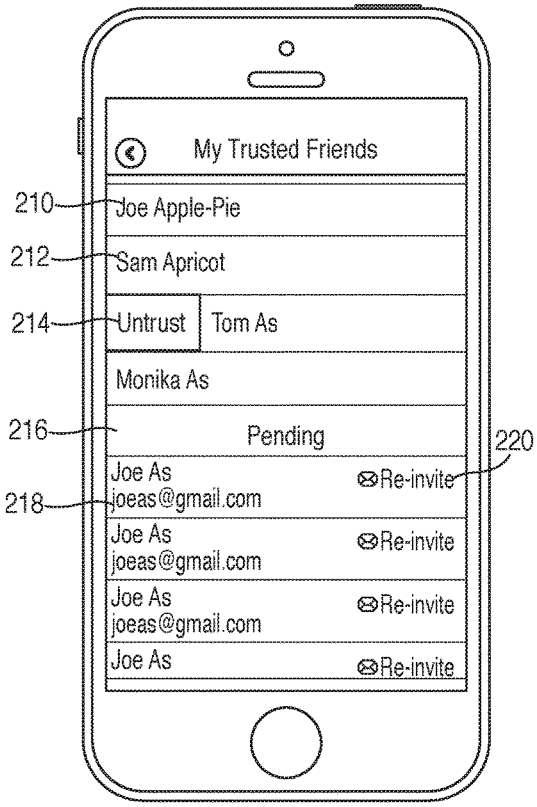
FIG. 21 illustrates an exemplary graphical user interface or display listing trusted friends associated with a user account, in accordance with an exemplary embodiment of the claimed invention.
Figure 22:
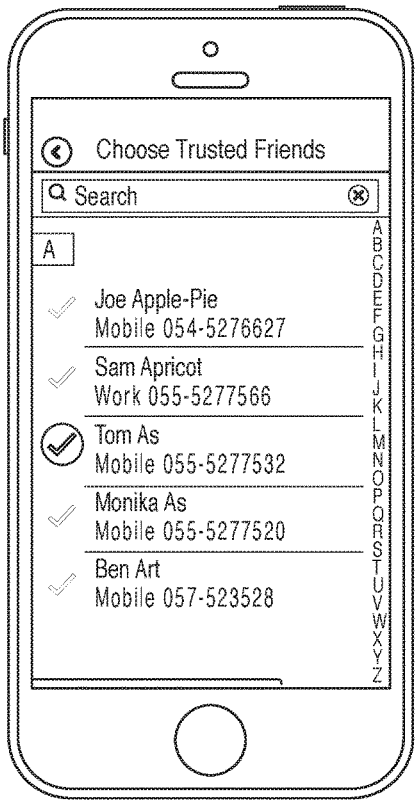
FIG. 22 illustrates an exemplary graphical user interface or display for selecting or choosing trusted friends associated with a user account, in accordance with an exemplary embodiment of the claimed invention.
Figure 23:
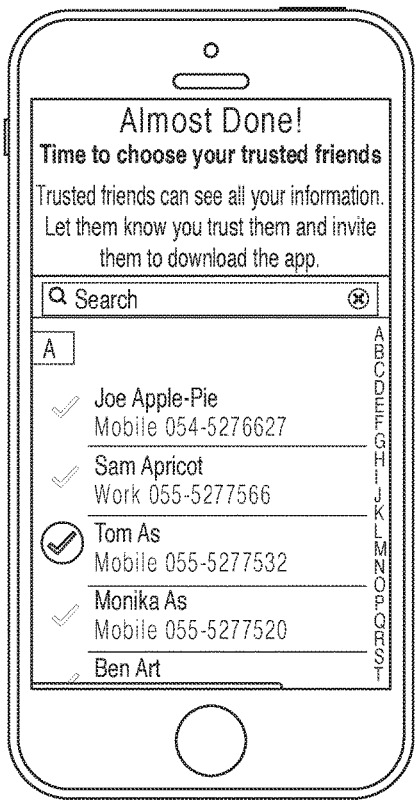
FIG. 23 illustrates an exemplary graphical user interface or display for selecting trusted friends associated with a user account upon initial setup of an account, in accordance with an exemplary embodiment of the claimed invention.
Figure 24:
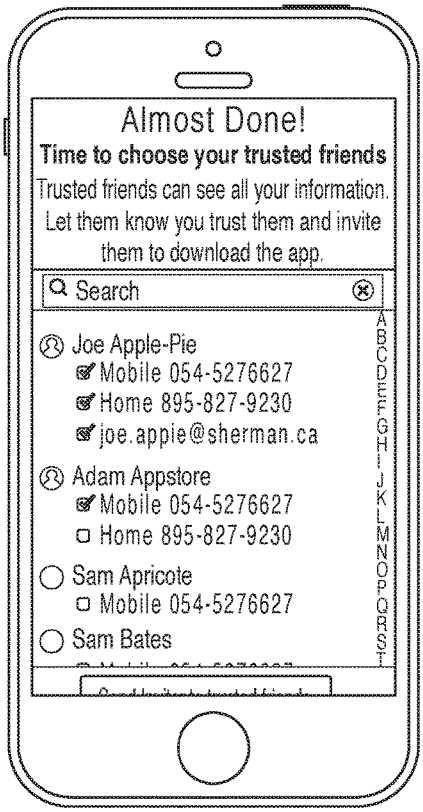
FIG. 24 illustrates an exemplary graphical user interface or display for selecting trusted friends (and trusted friends details) associated with a user account upon initial setup of account, in accordance with an exemplary embodiment of the claimed invention.

With reference to FIGS. 21 through 24, exemplary graphical user interfaces or displays for listing, managing and selecting trusted friends associated with a particular bracelet (or PA) are provided. A control 274 for accessing and setting trusted friends is found on main menu 142 illustrated in FIG. 28. Trusted friends are specially designated contacts that are granted permission by a user to view information about a PA, even if the information has been marked private and is not available to the public. As shown in FIG. 21, a list of trusted friends is displayed in a vertically scrollable list. Through this interface, trusted friends can be managed. Each cell 210, 212 of a trusted friend lists the name of the trusted friend. In a preferred embodiment, clicking on a cell also provides the trusted friend's title and the trusted friend's email address. An option to "untrust" a confirmed trusted friend is also provided by a side-swipe function to remove a trusted friend status for situations where a user no longer wishes to share private information with a particular individual. Interfaces for searching for and selecting trusted friends during ordinary use and after initial linking or sign up of a bracelet (from a user's contact list residing on a smart phone or remotely) are presented in FIGS. 22 through 24.

Pending requests to add one or more trusted friends are shown in the bottom half of the interface shown in FIG. 21. Trusting a friend causes the server to send a special invite email. The email invitation is different than the regular "share" email and clearly indicates that the recipient is being added as a trusted friend. When selecting a trusted friend, an email and link inviting a contact to become a trusted friend and download the application is provided to that individual at his/her the email address(es) 218. After the contact downloads the application and signs up, the contact is associated and confirmed as a trusted friend. If confirmation by a trusted friend is not received in a timely manner, a user may send a re-invite request 220 to invite the contact to become a trusted friend and install the application on the pending friend's smart phone.

Figure 25:
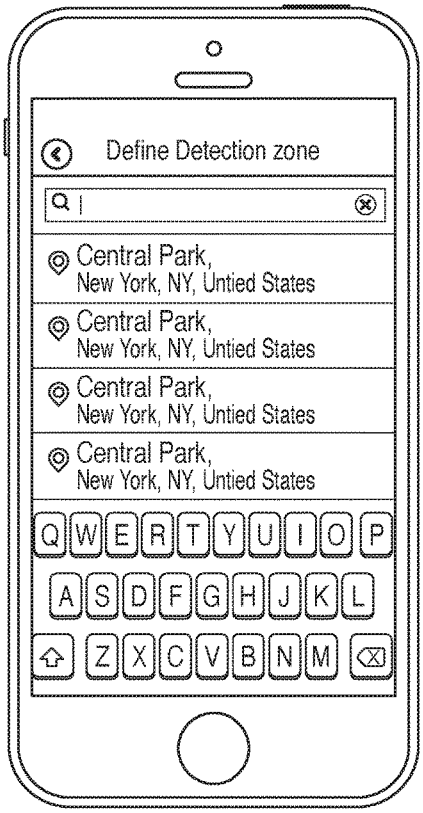
FIG. 25 illustrates an exemplary graphical user interface or display for defining a detection zone, in accordance with an exemplary embodiment of the claimed invention.
Figure 26:
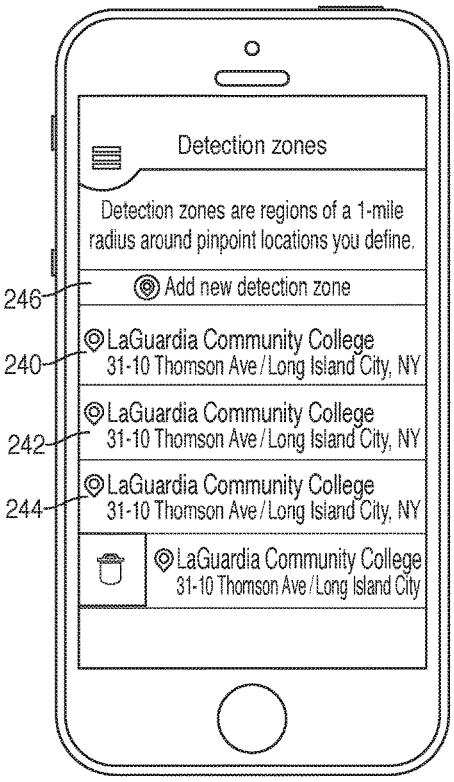
FIG. 26 illustrates an exemplary graphical user interface or display for adding a new detection zone, in accordance with an exemplary embodiment of the claimed invention.

Exemplary graphical user interfaces or displays for defining and controlling geo-fences or detection zones in accordance with an exemplary embodiment of the claimed invention are presented in FIG. 25 and FIG. 26. A control 272 for accessing and setting detection zones is found on main menu 142 illustrated in FIG. 28. A detection zone is an area which a user can define to limit the scanning for beacons to zones defined by the user. Thus, the system only monitors beacons when inside one of the up-to-20 predefined detection zones. When entering one of the regions, beacon monitoring commences and, conversely, when a user (and the user's smartphone) exits a predefined region or detection zone, beacon monitoring ceases. Thus, only when a smartphone with the application is in the detection zone will it be monitoring for beacons or bracelets of PAs. Otherwise, no beacons will be scanned for or detected by that particular user.

In an alternate preferred embodiment of the present invention, a detection zone is an area which a user can define to eliminate or otherwise limit notifications that are sent and received in response to the scanning and detection of beacons in zones defined by the user. Thus, although the system continuously monitors, scans for and detects beacons in all areas, including detection zones, the system will only send notifications of a PA wearing a bracelet linked to a particular beacon when a smartphone is inside one of the up-to-20 predefined detection zones and has detected that beacon. When entering one of the regions, beacon notification (not just monitoring, scanning and/or detection) commences and, conversely, when a user (and the user's smartphone) exits a predefined region or detection zone, beacon notifications cease. Thus, only when a smartphone with the application is in the detection zone will notifications be sent to a user of a detected beacon or bracelets of PAs corresponding to that beacon.

In a preferred embodiment, the detection zone interface is displayed to a user via the main menu illustrated at FIG. 28.

At the detection zones interface illustrated in FIG. 26, a list of detection zones is displayed in a vertically scrollable list. Each detection zone cell 240, 242, 244 includes the address and name (if applicable) of the selected address. Right-swiping a cell displays a delete request confirmation button and allows deletion of a detection zone. The first cell in the list serves as an add new detection zone button 246 to enable a user to add a new detection zone. When selected, the interface illustrated in FIG. 25 is displayed to enable a user to define a new detection zone, which includes a search bar for the user to enter the name of a place or an address. Suggested results are displayed based on the input text (using Google Place API and Google geocoding API or other similar API). Upon selected a search result, the screen is dismissed and the detection zones interface resumes. As stated in FIG. 26, detections zones are preferably defined as regions having a 1-mile radius around the pinpointed locations that are defined. It should be understood and appreciated that the radius may be increased or decreased as desired while still keeping within the spirit and scope of the invention.

An exemplary graphical user interface or display for a main menu 142 is presented in FIG. 28 and one for a settings menu 250 is presented in FIG. 27. In a preferred embodiment, settings menu 250 is accessible by pressing the settings control on main menu 142. Settings menu 250 has a My Account function 252 which links to basic account information presented in FIG. 29 and FIG. 30, including name 254 and email address 256 and a control function to edit and change a password 258 (and/or other account information). If the incorrect 'old' password is entered when a user attempts to change a password, an error message is received. Settings menu 250 also has a Logout function 260, and functions to send feedback 262 or to "love" the application 264. Settings menu 250 further provides one or more toggle switches to turn notifications (by email or by the application itself) on and off which pertaining to when another person invited by the user has joined, whether another person has accepted a 'trusted friend' invitation or other notifications.

Significantly, settings menu 250 also provides a series of controls for bracelet detection 266, 268, 270. By utilizing these controls for bracelet scanning and detection 266, 268, 270, a user can control whether its smartphone will scan for beacons. In other words, although the beacon remains on and in a functioning mode, these controls act as a switch, effectively turning the scanning function on and off. When the ON control 266 is active, the application and smartphone actively scans for beacons and when detected, populates the list of detected beacons and specifically, the corresponding bracelets and PAs. When the OFF control 270 is active, the application and smartphone do not scan for beacons. When the DETECTION ZONE control is active, the application and smartphone only scans for beacons when the smartphone is in a designated detection zone, as discussed above with respect to FIG. 25 and FIG. 26.

With reference to FIG. 35, there is shown an exemplary graphical user interface or display to add a bracelet. In order to add a bracelet, a text input field is provided for entering the bracelet name. A scan for bracelet button is provided for starting the scan process. Save and cancel buttons are also provided. The save button is disabled at this stage and remains disabled until the bracelet name is entered and a bracelet is selected. The cancel button dismisses the popup. Pressing the scan button commences or continues beacon monitoring. Detected beacons are displayed in a scrollable list sorted by closest (listed on top). A rescan button is visible for rescanning/refreshing the beacon list. Once a user selects the correct beacon, the save button becomes enabled and if pressed, the bracelet is added to the list and the popup is dismissed. A difference between the popup behavior on iOS and Android is that on Android, only beacon MAC addresses are listed. On iOS, a MAC address, UUID, Major & Minor values are displayed.

Figure 36:
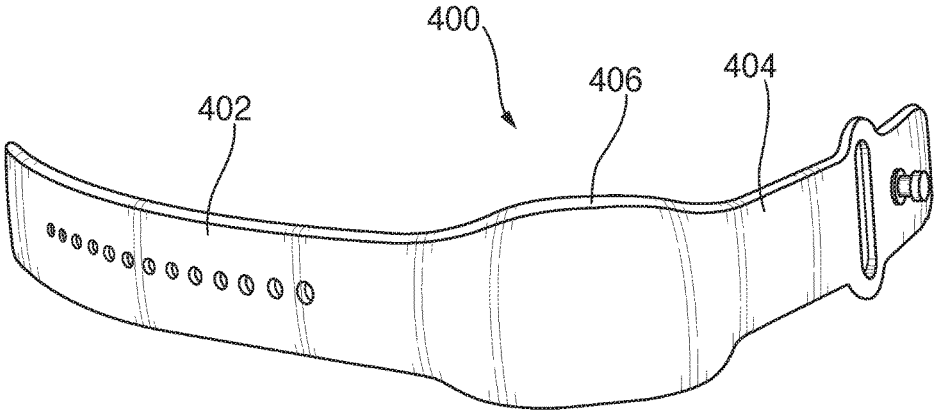
FIG. 36 illustrates an exemplary embodiment of a bracelet for housing a beacon

With reference to FIG. 36, there is shown a preferred embodiment of a bracelet for housing beacon 12 constructed in accordance with the present invention. A bracelet for housing beacon 12 is constructed of silicone or other flexible rubber or plastic material that can be molded to a desired shape and configuration. The bracelet comprises two interconnecting bands that are integrally molded to a housing that accommodates beacon 12. The bands of the bracelet are generally connected to one another like the bands of a conventional watch. However, it should be understood that other conventional means to connect the bands may be utilized instead. It is preferable for the bracelet to be constructed utilizing waterproof or water-resistant material to help prevent damage to the electronic beacon component should the bracelet be exposed to water. In an alternate preferred embodiment, charms or other visual indicia may be applied to either band 402, 404 indicating that a PA, for example, has an allergy to peanuts or other allergens.

In a preferred embodiment of the present invention, a bracelet is utilized to communicate identification information which in turn is utilized to transmit allergy information about a PA. It should be appreciated and understood that other items other than a bracelet may be utilized while keeping within the spirit and scope of the present invention. For example, a pendant, token, wearable item or pocket-sized device may incorporate the necessary beacon and associated hardware and be utilized in place of or in conjunction with a bracelet. The bracelet houses a Bluetooth beacon that is Bluetooth low-energy compliant. The beacon also supports Apple's iBeacon protocol and meets the following additional criteria: (1) broadcasts UUID, major and minor values; (2) all beacons must have the same UUID, which must be unique and different from those found on common beacon brands, such as Estimote; (3) the minor value on every beacon should be different and they should be numbered continuously starting at 1. Moreover, the Bluetooth module mac address must be unique and all beacons should have as long an identical prefix as possible (i.e., out of the 12 alphanumerical characters, the first 6 should preferably be identical on all beacons). In a preferred embodiment, battery capacity must be sufficient to last a year at the predefined broadcast power level. This requirement can be alleviated if battery replacement is possible for the beacon.

The accompanying specification and drawings only illustrate an exemplary embodiment of a system communicating allergy information, its constituent parts, and associated methods and processes. However, other exemplary embodiments are possible, and the drawings are not intended to be limiting in that regard. Thus, although the description above and accompanying drawings contains much specificity, the details provided should not be construed as limiting the scope of the embodiment(s) but merely as providing illustrations of some of the presently preferred embodiment(s). The drawings and the description are not to be taken as restrictive on the scope of the embodiment(s) and are understood as broad and general teachings in accordance with the present invention. While the present embodiment(s) of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention.

The invention claimed is:

1. An allergy warning and protection system configured to be operated by a user utilizing a smart device having an interface display screen, Internet connectivity and location identifying technology, comprising:

a communication beacon having a unique identifier and that generates and emits a signal encoded with said unique identifier;

a wearable configured to accommodate said communication beacon;

a database comprising a plurality of data entries that are linked to said wearable, said data entries defined by said unique identifier, an allergy ID and an allergy sensitivity ID;

a processor controlled server, said server being operatively connected to said smart device and to access said database in response to a query from said smart device, utilizing said unique identifier, for said allergy ID;

wherein said processor controlled server returns said allergy ID to said interface display screen in response to said query utilizing said unique identifier and said smart device receives a notification notifying said user that an individual with an allergy is nearby.

2. The allergy warning and protection system of claim 1, wherein said query from said smart device is also for said allergy sensitivity ID, and wherein said processor controller server also returns said allergy sensitivity ID to said interface display screen in response to said query utilizing said unique identifier.

3. The allergy warning and protection system of claim 1, wherein said allergy sensitivity ID is defined by at least one of an airborne level allergy sensitivity, a contact level allergy sensitivity and an ingestion level allergy sensitivity.

4. The allergy warning and protection system of claim 1, wherein said smart device comprises an application having program instructions stored on a non-transitory computer readable medium that is configured to scan for said beacon and display said allergy ID and allergy sensitivity ID on said interface display screen when said application detects said beacon.

5. The allergy warning and protection system of claim 2, wherein when said processor controlled server returns said allergy ID and said allergy sensitivity ID to said interface display screen in response to said query utilizing said unique identifier, a visual and audible notification is displayed on said interface display screen.

6. An allergy warning and protection system configured to be operated by a user utilizing a smart device having an interface display screen, Internet connectivity and location identifying technology, comprising:

a wearable with a housing formed of water resistant silicone material;

a beacon that generates and emits a short-range signal with an identifier code, said beacon being encapsulated within said housing of said wearable;

a database comprising a data set with a plurality of values corresponding to said identifier code, an allergy ID and a name associated with an individual with an allergy, and an allergy sensitivity ID;

a processor controlled server, said server being operatively connected to said smart device to access said database in response to a query utilizing said identifier code to determine said allergy ID that is matched to said identifier code;

wherein said processor controlled server is configured to notify said user operating said smart device and transmit said allergy ID to said interface display screen in response to said query utilizing said unique identifier after detecting said signal.

7. The allergy warning and protection system of claim 6, wherein said server being operatively connected to said smart device to access said database in response to a query utilizing said identifier code to further determine said allergy sensitivity level ID that is matched to said identifier code and wherein said processor controlled server is configured to notify said user operating said smart device and further transmit said allergy sensitivity level ID to said interface display screen in response to said query utilizing said unique identifier after detecting said signal.

8. The allergy warning and protection system of claim 6, wherein said allergy sensitivity level ID is defined by at least one of an airborne level allergy sensitivity, a contact level allergy sensitivity and an ingestion level allergy sensitivity.

9. The allergy warning and protection system of claim 6, wherein said plurality of values includes an emergency contact ID.

10. The allergy warning and protection system of claim 6, wherein said plurality of values includes a trusted contact ID.

11. The allergy warning and protection system of claim 10, wherein said trusted contact ID is associated with said user in said database and wherein said name of said individual with an allergy is transmitted from said server to said interface display screen only when said user is associated with said trusted contact ID.

12. The allergy warning and protection system of claim 10, wherein said interface display screen is configured to display a cell corresponding to said allergy ID after said signal from said beacon is detected.

13. The allergy warning and protection system of claim 6, wherein said short-range signal is a Bluetooth signal.

* * * * *